United States Patent [19]

Fender

[11] 4,281,576

[45] Aug. 4, 1981

[54] BRIDGE FOR STRINGED INSTRUMENTS

[76] Inventor: C. Leo Fender, 2851 Rolling Hills Dr., Sp. 33, Fullerton, Calif. 92635

[21] Appl. No.: 89,164

[22] Filed: Oct. 29, 1979

[51] Int. Cl.[3] ..... G10D 3/04

[52] U.S. Cl. ..... 84/298; 84/307

[58] Field of Search ..... 84/298, 299, 307, 314 N

[56] References Cited

U.S. PATENT DOCUMENTS

| | | | |
|---|---|---|---|
| 3,178,985 | 4/1965 | Jeranson | 84/307 |
| 3,290,980 | 12/1966 | Fender | 84/307 |
| 4,031,799 | 6/1977 | Fender | 84/307 |

*Primary Examiner*—Lawrence R. Franklin

*Attorney, Agent, or Firm*—Philip M. Hinderstein

[57] ABSTRACT

In a bridge for stringed instruments of the type including a base member, a plurality of drums, and means connecting the drums to the base member in end-to-end relationship for independent lateral movement in two orthogonal directions to separately adjust the length and height of each string, there is disclosed an improved construction wherein the strings are conducted into engagement with the drums so as to apply an axial force to each of the drums to urge all of the drums axially into contact with each other and the first drum into contact with a fixed abutment on the base member.

1 Claim, 4 Drawing Figures

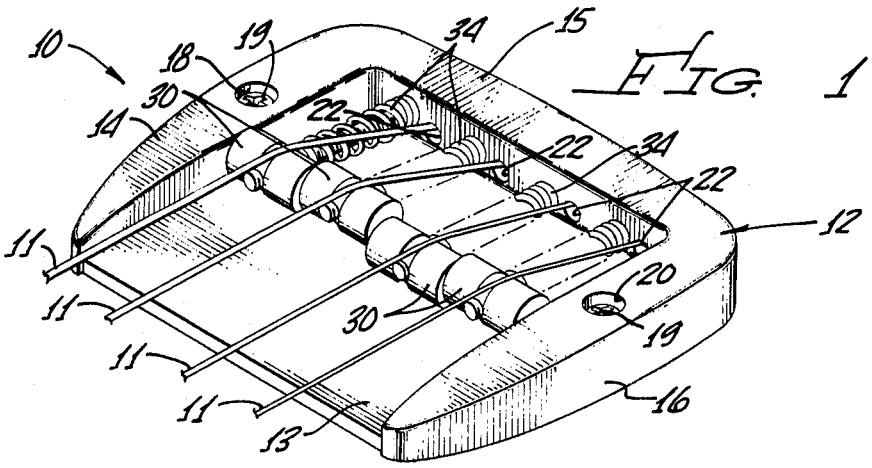
FIG. 1
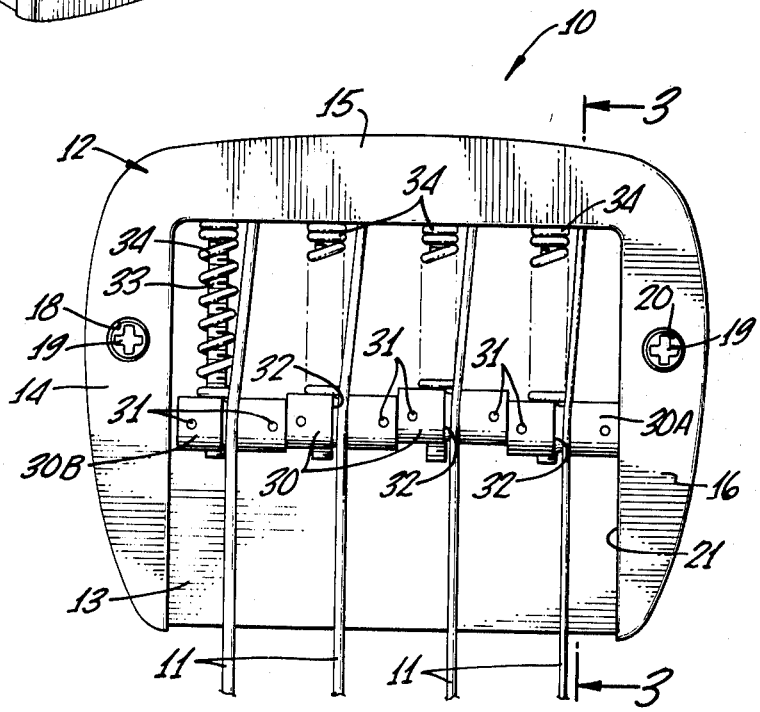
FIG. 2.
FIG. 3.
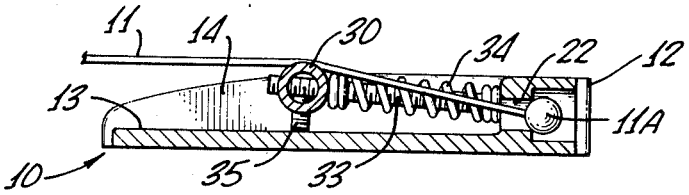
FIG. 4.
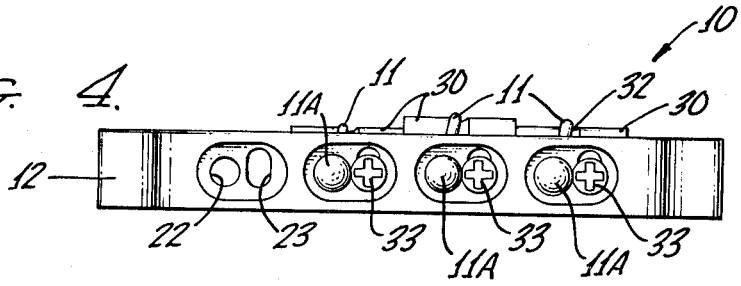

BRIDGE FOR STRINGED INSTRUMENTS

BACKGROUND OF THE INVENTION

1. Field of the Invention

The present invention relates to a bridge for stringed instruments and, more particularly, to a stringed instrument bridge which increases the tone sustaining capabilities of the strings and eliminates certain undesirable characteristics of bridges used heretofore.

2. Description of the Prior Art

The function of the bridge of a stringed instrument is to establish fixed connection points for first ends of the strings of such instrument. In many instruments, the spacing between the bridge and the body of the instrument is adjustable to permit adjustment of the height of each string relative to the neck of the instrument. This adjustment makes the instrument adaptable to different users since the spacing between the strings and the neck is a matter of personal choice and substantial variations exist.

Since the connection points of the other ends of the strings are fixed at the end of the instrument neck, adjustment of the spacing between the bridge and the instrument body usually results in a change in the length of each string. In the case of a solid body, fretted instrument, such as an electric guitar or bass, this change in the length of the strings creates a noticeable change in the location of the octave point of each string. However, since the octave points must be exactly aligned with one of the frets of the instrument in order to insure proper operation of the strings, it is necessary to simultaneously adjust the lateral position of the bridge when adjustments are made to the height thereof.

For the above reasons, many bridges available today include a plurality of drums positioned in end-to-end relationship, each string of the instrument being conducted over one of the drums, the drums being connected to the bridge in a manner which permits their lateral movement in two orthogonal directions so as to separately adjust the length of each string and the height of each string relative to the neck of the instrument. Such a bridge permits the greatest latitude of adjustment possible for each string.

While bridges of the above type provide the degree of adjustability required, they create certain unwanted problems. That is, the drums are typically connected to the bridge in a manner which permits a limited amount of axial movement of each drum. As a result, the vibrations of the strings which are conducted over such drums cause the drums themselves to vibrate. Since the tone sustaining capability of a string is a direct function of the rigidity of its end point connections, the ability of the drums to vibrate, which drums define one end point connection, substantially reduces the tone sustaining capability of the strings below the level which is theoretically attainable.

In my prior U.S. Pat. No. 4,031,799, this problem is solved by providing a novel bridge for stringed instruments including a plurality of independently moveable drums which permit separate adjustment of the length of each string and the height of each string relative to the neck of the instrument. Such bridge substantially reduces the ability of the drums to vibrate, substantially increasing the tone sustaining capabilities of each string over that obtainable theretofore. According to the invention of my prior patent, this is achieved by providing the base member of the bridge with a plurality of holes which are positioned below the bolts which connect the drums to the base member. The strings extend through these holes and are partially wrapped around the bolts before being conducted to the grooves in the drums. By partially wrapping the strings around the bolts, a force is applied to each of the bolts, which force is transmitted to the drums to urge all of the drums into contact with each other and a fixed post connected to the base member. By urging all of the drums axially into contact with each other and a fixed post, the ability of the drums to vibrate is substantially reduced, maximizing the tone sustaining capabilities of the strings.

While the bridge of my prior patent is effective in reducing the ability of the drums to vibrate, substantially increasing the tone sustaining capabilities of each string over that obtainable theretofore, it has been found, in practice, to be inconvenient to construct a bridge assembly in the manner described and claimed therein and to conduct the strings into contact with the bolts connecting the drums to the base member. It is an object of the present invention to overcome the shortcomings encountered with the bridge of my prior patent.

SUMMARY OF THE INVENTION

According to the present invention, there is provided a novel bridge for stringed instruments. As is the case with my prior patent, the present bridge includes a plurality of independently moveable drums which permit separate adjustment of the length of each string and the height of each string relative to the neck of the instrument thereby permitting the greatest latitude of adjustment possible for each string. However, the present bridge substantially reduces the ability of the drums to vibrate in a convenient and practical manner, substantially increasing the tone sustaining capabilities of each string over that obtainable heretofore.

Briefly, the present bridge for a stringed instrument including a body and a neck comprises: a base member having a first section connectable to the body of the instrument and a second section connected to one end of the first section and extending perpendicular thereto; a plurality of drums, each of the drums having an internally threaded hole extending laterally therethrough; a plurality of bolts extending through the second section of the base member and through the holes in the drums whereby rotation of the bolts relative to the drums moves the drums toward or away from the second section of the base member to separately adjust the length of each string; a fixed abutment preferably made integral with the base member, adjacent one end of the first one of the drums; and a plurality of holes in the second section of the base member, one for each of the drums, the strings of the instrument extending through the holes in the base member and over the drums at an angle thereto, without contacting the bolts, so as to apply an axial force to each of the drums in the direction of the fixed abutment to urge all of the drums axially into contact with each other and the first drum into contact with the abutment.

OBJECTS, FEATURES, AND ADVANTAGES

It is therefore an object of the present invention to solve the problems caused by the ability of drums to vibrate in a bridge assembly for stringed instruments of the type including a plurality of independently moveable drums. It is a feature of the present invention to solve these problems by applying an axial force to each of the drums to urge all of the drums axially into contact with each other and a first drum into contact with a fixed abutment on the bridge. An advantage to be derived is that the present bridge increases the tone sustaining capabilities of the strings. Another advantage is that in a bridge including a plurality of independently moveable drums, the ability of the drums to vibrate is substantially reduced. A still further advantage is that the above advantages are achieved in a practical and effective manner.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is a perspective view of a bridge constructed in accordance with the teachings of the present invention;

FIG. 2 is a top plan view of the bridge of FIG. 1;

FIG. 3 is a sectional view taken along the line 3—3 in FIG. 2; and

FIG. 4 is a rear elevation view of the bridge of FIG. 1.

DESCRIPTION OF THE PREFERRED EMBODIMENT

Referring now to the drawings, there is shown a bridge, generally designated 10, which is designed primarily for use with a stringed instrument (not shown) including a body, a neck, and a plurality of strings. The particular embodiment of bridge 10 shown is designed for an electric bass having four strings 11.

As is known in such instruments, it is desirable to be able to adjust the height of each string 11 relative to the neck of the instrument to satisfy the personal desires of individual musicians. It is also known that adjustment of the height of a string 11 changes the length and the location of the octave point thereof. Since the octave point must be exactly aligned with the frets of the instrument, it is necessary to simultaneously adjust the lateral position of bridge 10 when adjustments are made to the height of strings 11. Bridge 10 permits this separate adjustment of the length and height of each string 11.

Bridge 10 includes a base member 12 having a first section 13 which is generally planar for connection to the body of an instrument. At three of the four ends of section 13, base member 12 has an increased thickness to provided sections 14, 15, and 16 which form a generally U-shape. Connection of bridge 10 to the body of an instrument may be achieved by providing multiple holes in base member 12, such as holes 18 and 20 in sections 14 and 16. By providing the body of the instrument with aligned holes, bolts 19 extending through holes 18 and 20 and into the aligned holes in the body may be used to firmly secure base member 12 to the body of the instrument.

Sections 14, 15, and 16 of base member 12 are preferably made integral with section 13 to provide a unitary construction. Section 16 of base member 12 defines an abutment 21 which serves an additional function, as will be described more fully hereinafter. Section 15, which is positioned between sections 14 and 16, has four pairs of adjacent holes 22 and 23 therein, all of holes 22 and 23 having their axes parallel to the plane of section 13 and parallel to the direction of strings 11.

Bridge 10 also includes a plurality of identical, hollow drums 30, one drum for each string 11, drums 30 being positioned in end-to-end relationship for independent lateral movement in two orthogonal directions to separately adjust the length of each string 11 and the height of each string 11 relative to the instrument neck. More particularly, and as explained more fully in my prior patent, each drum 30 has a first internally threaded hole extending laterally through both sides thereof, slightly offset from the center thereof, a pair of second internally threaded holes extending only through one side thereof, perpendicular to the first hole and on opposite sides thereof, and a pair of third unthreaded holes 31 which extend only through the other side thereof, coaxial with the second holes, holes 31 having a smaller diameter than the second holes. Each drum 30 also includes a lateral groove 32 in the outer surface thereof, grooves 32 being centered relative to the ends of drums 30.

Drums 30 are connected to base member 12 of bridge 10 by means of a plurality of identical bolts 33 which extend through holes 23 in section 15 of base member 12 and through the first holes in drums 30. A spring 34 surrounds each bolt 33, between its associated drum 30 and section 15 of base member 12. Springs 34 urge drums 30 away from section 15 of base member 12, insuring that the heads of bolts 33 remain in contact with section 15. It will be evident that rotation of bolts 33 relative to drums 30 moves drums 30 laterally, towards or away from section 15 of base member 12, providing one degree of lateral movement of each of drums 30.

Bridge 10 also includes a plurality of set screws 35, two for each of drums 30. A set screw 35 is positioned in each threaded second hole in drum 30, facing holes 31 therein. The other ends of all set screws 35 extend outwardly from drums 30 into contact with section 13 of base member 12. Thus, the axial positions of the two set screws 35 relative to their associated drum 30 determines the spacing between drums 30 and section 13 of base member 11, providing a second degree of lateral movement of each of drums 30. A conventional Allen wrench may be extended through any of holes 31 in drums 30 to engage the socket in the head of the facing set screw 35 to rotate set screws 35 relative to drums 30.

It should be noted that drums 30 are positioned in end-to-end relationship between sections 14 and 16 of base member 12. As seen most clearly in FIG. 2, the combined length of drums 30 is slightly less than the spacing between sections 14 and 16 to permit freedom of movement of drums 30.

Bridge 10 further includes means for urging all of drums 30 in an axial direction, into contact with each other, and the first drum 30A into contact with abutment 21 formed by section 16. More specifically, strings 11 are adapted to extend through holes 22 in section 15 of base member 12 with the beads 11A connected to the ends of strings 11 trapped behind section 15 of base member 12. From holes 22, strings 11 extend over drums 30, through the grooves 32 therein, and are then directed over the neck of the instrument. It is significant to note that holes 22 are offset relative to grooves 32 in drums 30 and that strings 11 extend directly from holes 22 to grooves 24 without contacting bolts 33 or springs 34. As seen in FIG. 2, this offset of holes 22 relative to grooves 32 cause strings 11 to extend between drums 30 and section 15 of base member 12 at an acute angle relative to the remainder of strings 11 which extend from drums 30 to the neck of the instrument.

In operation, strings 11 are connected to an instrument by extending them through holes 22 in base member 12 and over drums 30 to the neck of the instrument. As will be evident from an inspection of FIG. 3, rotation of set screws 35 relative to drums 30 elevates drums 30 relative to section 13 of base member 12, thereby permitting individual adjustment of the height of each string 11 relative to the instrument neck. Once the height adjustment is made, the individual bolts 33 may be rotated to move drums 30 in the direction of strings 11 to adjust the length thereof so that the octave points coincide with the frets of the instrument.

Because of the location of holes 22 in section 15 of base member 12 relative to grooves 32 in drums 30, strings 11 change direction as they pass over the individual drums 30. This applies a force to each of drums 30 which is directed to the right, as viewed in FIG. 2. This force urges all of drums 30 to the right, as viewed in FIG. 2 and, more particularly, urges drum 30A into contact with abutment 21, abutment 21 operating as a fixed abutment connected to or made integral with base member 12. The remaining drums 30 are forced into contact with each other so that the entire space between sections 14 and 16 of base member 12 is between the drum 30 at the other end of the row, drum 30B, and section 14. By urging all of drums 30 axially into contact with each other and a fixed abutment, the ability of drums 30 to vibrate is substantially reduced, maximizing the tone sustaining capabilities of strings 11.

It can therefore be seen that according to the present invention, the problems encountered heretofore with this type of bridge have been solved. Bridge 10 includes a plurality of independently moveable drums 30 which permit separate adjustment of the height of each string 11 and simultaneous adjustment of the length of each string 11 thereby permitting the greatest latitude of adjustment possible for each string 11. However, bridge 10 substantially reduces the tendency for drums 30 to vibrate, substantially increasing the tone sustaining capabilities of strings 11 over that obtainable heretofore. Furthermore, bridge 10 is an improvement over the bridge of my prior patent in that it is not necessary to conduct strings 11 through the body of the instrument bridge 10 is connected to and it is also not necessary to conduct strings 11 into contact with bolts 33 or springs 34. Thus, bridge 10 is a more practical and desirable solution to the problems addressed herein and in my prior patent.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A bridge for a stringed instrument including a body and a neck comprising:

a base member rigidly connectable to said body of said instrument, said base member having a first section connectable to said body of said instrument and a second section connected to one end of said first section and extending perpendicular thereto;

a plurality of drums, each of said drums having an internally threaded hole extending laterally therethrough;

a plurality of bolts extending through said second section of said base member and through said holes in said drums for connecting said drums to said base member in end-to-end relationship for independent lateral movement in two orthogonal directions whereby rotation of said bolts relative to said drums moves said drums towards or away from said second section of said base member;

a fixed abutment associated with said base member, adjacent one end of the first one of said drums; and a plurality of holes in said second section of said base member, one for each of said drums, said holes being positioned intermediate said bolts, said strings extending through said holes in said base member and over said drums at an acute angle relative to said bolts without engagement with said bolts so as to apply an axial force to each of said drums and to urge all of said drums axially into contact with each other and said first drum into contact with said abutment.

* * * * *